US006000304A

United States Patent [19]

Hegemier

[11] Patent Number: 6,000,304

[45] Date of Patent: Dec. 14, 1999

[54] CHAIN PLIERS

[76] Inventor: Rolland J. Hegemier, 11610 Wabash Rd., Rockford, Ohio 45882

[21] Appl. No.: 08/820,637

[22] Filed: Mar. 15, 1997

[51] Int. Cl.[6] ..... B25B 7/12

[52] U.S. Cl. ..... 81/370; 81/426.5; 59/7

[58] Field of Search ..... 81/15.8, 370, 424.5, 81/426.5; 59/7

[56] References Cited

U.S. PATENT DOCUMENTS

| | | | |
|---|---|---|---|
| 3,192,804 | 7/1965 | Petersen et al. . | |
| 4,157,594 | 6/1979 | Raabe | 81/424.5 X |
| 5,056,385 | 10/1991 | Petersen | 81/370 |
| 5,193,336 | 3/1993 | King | 81/426.5 X |
| 5,435,214 | 7/1995 | Sisson | 81/370 X |

*Primary Examiner*—James G. Smith
*Attorney, Agent, or Firm*—Michael I. Kroll

[57] ABSTRACT

A chain pliers (10) comprising a body (12) and a first jaw (14). A component (16) is for attaching in a stationary manner the first jaw (14) to a top end (18) of the body (12). A second jaw (20) is provided. An element (22) is for attaching in a pivotal manner the second jaw (20) to the top end (18) of the body (12) opposite from the first jaw (14). A vise grip assembly (24) is between the body (12) and the second jaw (20). A person can operate with one hand the vise grip assembly (24) and move the second jaw (20) towards the first jaw (14), to engage with opposite ends of a chain (26) to tighten the chain (26).

1 Claim, 3 Drawing Sheets

CHAIN PLIERS

BACKGROUND OF THE INVENTION

1. Field of the Invention

The instant invention relates generally to chain pipe wrenches and more specifically it relates to a chain pliers. The chain pliers will pull a chain tight so that the hands are free to do chain repair after the tool is clamped in place.

2. Description of the Prior Art

Numerous chain pipe wrenches have been provided in prior art. For example, U.S. Pat. Nos. 612,525 to Miller; 1,364,214 to Steward; 2,547,748 to Freer; 2,932,226 to Seppola; 3,192,804 to Petersen et al. and 4,477,937 to Costello all are illustrative of such prior art. While these units may be suitable for the particular purpose to which they address, they would not be as suitable for the purposes of the present invention as heretofore described.

MILLER, ROBERT J.

Pipe Wrench

U.S. Pat. No. 612,525

In a device of the class described, the combination with a main lever, of a secondary lever provided with a rigid or integrally formed off set. The offset being pivoted to the main lever. A linked chain is secured to the main lever. A member is pivoted to the secondary lever and adjustably engage with the free extremity of the chain substantially as set forth.

STEWARD, CHARLES C.

Wrench

U.S. Pat. No. 1,364,214

In a wrench of the type described, a handle portion is provided at one end thereof with spaced jaws pivotally connected therewith and are provided upon their opposed faces with gripping teeth. A lever is positioned adjacent one side of the handle portion and is pivoted intermediate its ends. A flexible element is secured to one end of the lever and embodies restricted portions. A pair of spaced shoulders are formed on one of the jaws and is adapted to receive therebetween the restricted portions of the flexible element.

FREER, ROBERT R.

Flexible Loop Jar Cap Wrench

U.S. Pat. No. 2,547,748

An adjustable screw cap remover comprising a pair of lever members, each having a handle portion and an arm portion extending laterally from one end of the handle portion. Pivotal means connects the lever members adjacent the juncture of the handle and arm portions, so that the arm portions extend laterally outward of the pivotal means in substantially opposite directions. A flexible member is attached at its one end to one of the arm portions. Adjustment means associated with the other arm portion is adapted to engage the flexible member in a plurality of positions so as to form a loop, whereby the loop may be varied in size. A flat disk is disposed intermediate the arm portions and opposite to the loop. The disk has a pair of arcuately shaped toothed portions rigid therewith. The toothed portions are disposed relative to each other to form a substantially V-shaped groove. A screw cap placed within the loop may be drawn into the groove and secured therein when the handle portions are moved toward each other.

SEPPOLA, ASLE

Adjustable Link-Jaw Clamping Wrench

U.S. Pat. No. 2,932,226

An adjustable clamping wrench for pipes and the like comprising in combination an elongated main handle. A pair of spaced and parallel plates are formed on one end thereof. Arcuately concave, toothed semi-jaws are formed on the front ends of the plates. An articulated, internally toothed jaw assembly is mounted on the plates. The articulated jaw assembly is anchored by one end thereof between the lower sides of the plates. Actuating linkage extends from the other end of the articulated jaw assembly and extends downwardly between the plates. Guide means span the plates rearwardly of the semi-jaws, the actuating linkage passes over the guide means. An actuating lever is pivoted by one end thereof between the plates and extends rearwardly underneath the main handle, means on the front end of the actuating lever is adjustably engageable with the actuating linkage.

PETERSON, CHRISTIAN BECKER, WILLIAM L. ALLEMEIER, EMIL A.

Chain Clamps

U.S. Pat. No. 3,192,804

IN a wrench having a pair of relatively movable hand gripping members, the improvement which comprises one of the members having a forward end extending beyond the forward end of the other of the members. The one member forward end forms a claw portion. A movable clamping element interconnects the members. The movable clamping element includes a leg pivotally connected at one end to the forward end of the other member and at its other end to the one member beneath the claw portion. The element includes an integral arm projecting from the leg. A length of chain is pivotally connected to the end of the arm. The chain is adapted to be wrapped peripherally of a work piece and to then extend past the arm. The arm has a portion thereof offset from the plane of the remainder of the arm. The offset portion has a base portion out of alignment with the claw portion. The base portion and the remainder of the arm defines between them an opening in alignment with the claw portion. The chain is disposed within the opening when extending past the arm. The claw portion is engageable with the chain upon manual operation of the members, whereby the chain grips tightly against a major portion of the periphery of the work piece.

COSTELLO, JAMES

Combined Pliers, Clamp and Wrench

U.S. Pat. No. 4,477,937

A combined wrench, locking pliers and chain clamp using a toggle for the gripping and clamping functions.

SUMMARY OF THE INVENTION

A primary object of the present invention is to provide a chain pliers that will overcome the shortcomings of the prior art devices.

Another object is to provide a chain pliers that will pull a chain tight, so that a person does not have to loosen a chain adjuster, while it allows the hands to be completely free to do chain repair after the tool is clamped in place to opposite ends of the chain.

An additional object is to provide a chain pliers that can be used on roller chains, on conveyors, motorcycles, bicycles, farm machinery, plant machinery and all chains with master links.

A further object is to provide a chain pliers that is simple and easy to use.

A still further object is to provide a chain pliers that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGS.

Various other objects, features and attendant advantages of the present invention will become more fully appreciated as the same becomes better understood when considered in conjunction with the accompanying drawings, in which like reference characters designate the same or similar parts throughout the several views, and wherein, FIG. 1 is a top perspective view of the instant invention.

Similar reference characters denote corresponding features consistently throughout the attached drawings.

DETAILED DESCRIPTION OF THE PREFERRED EMBODIMENTS

Figure 1:
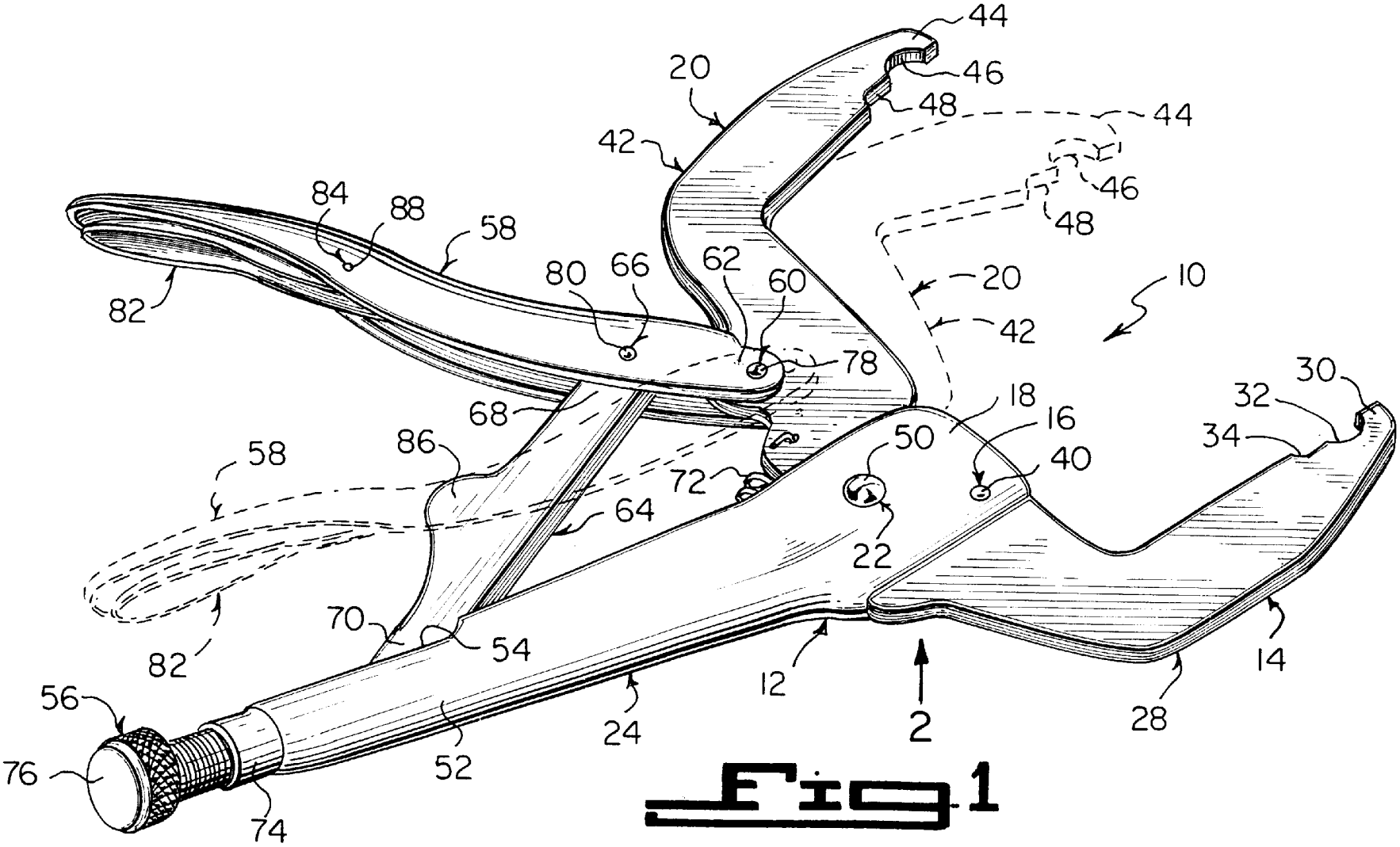
Figure 2:
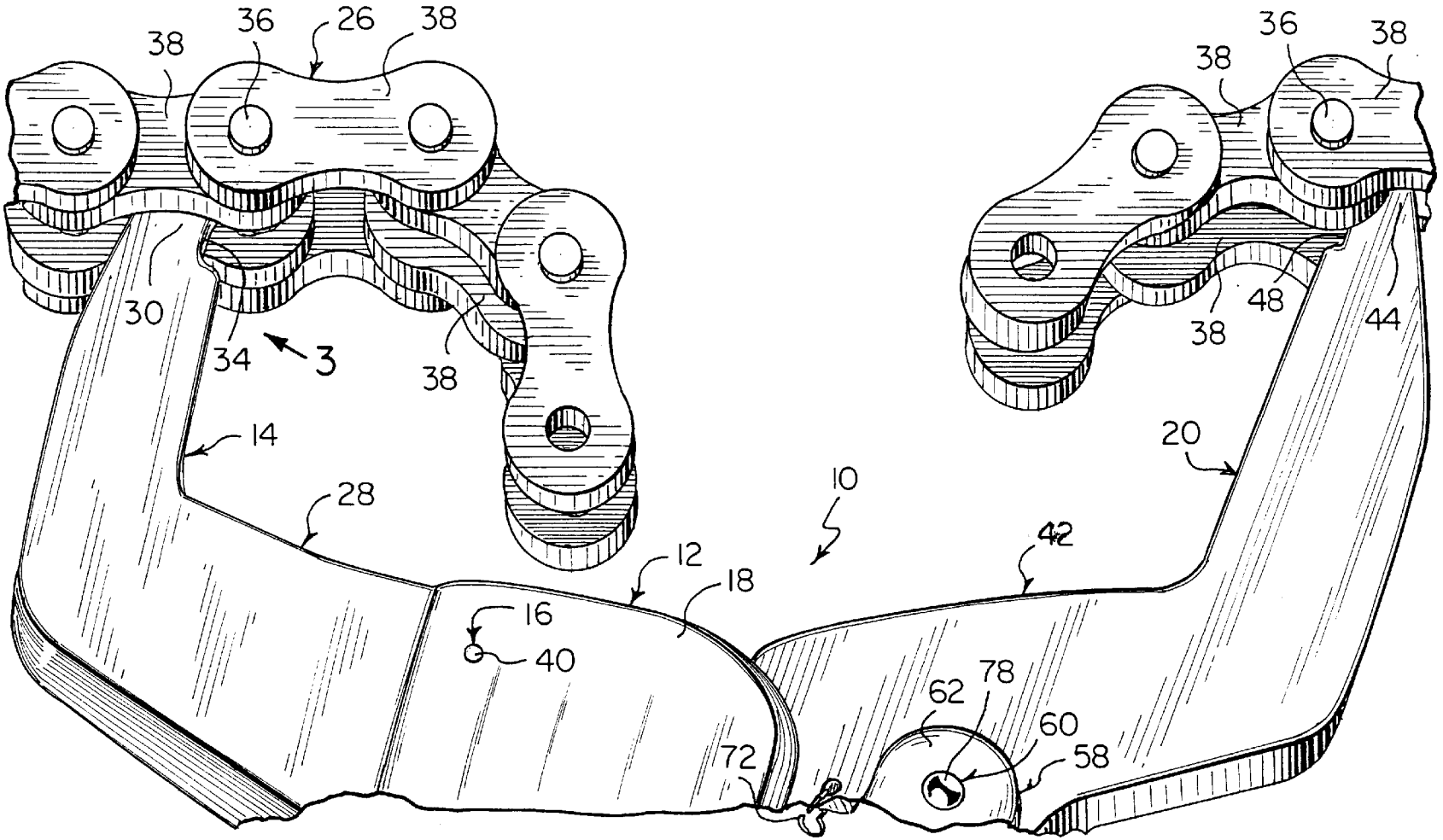
FIG. 2 is an enlarged bottom perspective view of a portion thereof taken in the direction of arrow 2 in FIG. 1, showing the hook ends of the L-shaped jaws engaging opposite ends of a chain.
Figure 3:
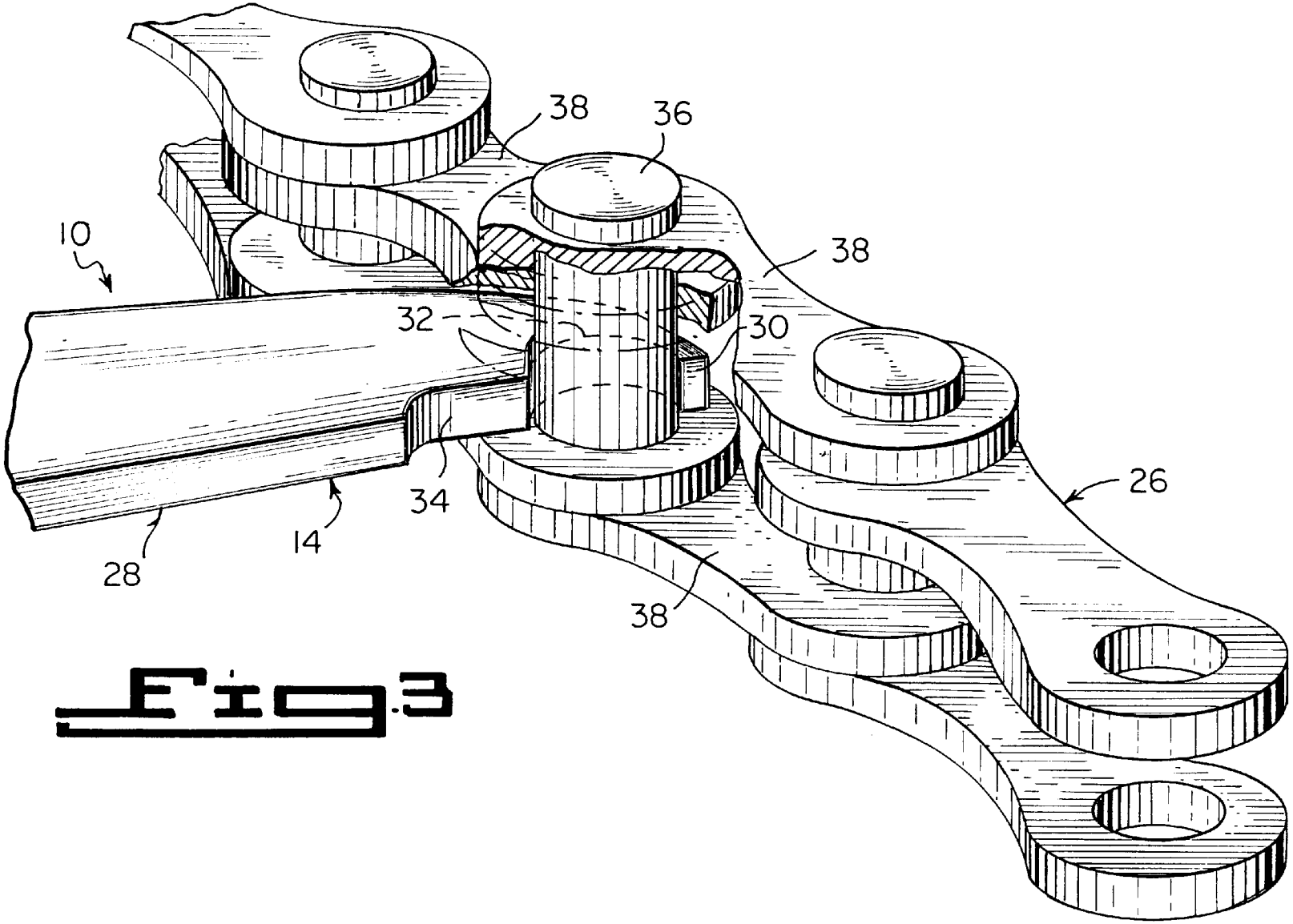
FIG. 3 is an enlarged perspective view taken in the direction of arrow 3 in FIG. 2, with parts broken away and in section, showing in greater detail the hook end in engagement with one of the pivot pins of the chain.

Turning now descriptively to the drawings, in which similar reference characters denote similar elements throughout the several views, FIGS. 1 to 3 illustrate a chain pliers 10 comprising a body 12 and a first jaw 14. A component 16 is for attaching in a stationary manner the first jaw 14 to a top end 18 of the body 12. A second jaw 20 is provided.

An element 22 is for attaching in a pivotal manner the second jaw 20 to the top end 18 of the body 12 opposite from the first jaw 14. A vise-like grip assembly 24 is between the body 12 and the second jaw 20. A person can operate with one hand the vise-like grip assembly 24 and move the second jaw 20 towards the first jaw 14, to engage with opposite ends of a chain 26 to tighten the chain 26.

The first jaw 14 includes an L-shaped arm 28. A hook member 30 is formed on an upper end of the L-shaped arm 28. The hook member 30 has a semi-circular groove 32 and a notch 34 facing inwardly therefrom. The semi-circular groove 32 in the hook member 30 can engage with one pivot post 34 between links 36 of the chain 26. The stationary attaching component 16 is a rivet 40 extending through the top end 18 of the body 12 and a lower portion of the first jaw 14.

The second jaw 20 consists of an L-shaped arm 42. A hook member 44 is formed on an upper end of the L-shaped arm 42. The hook member 44 has a semi-circular groove 46 and a notch 48 facing inwardly therefrom. The semi-circular groove 46 in the hook member 44 can engage with one pivot post 36 between links 38 of the chain 26. The pivotal attaching element 22 is a pivot pin 50 extending through the to end 18 of the body 12 and a lower portion of the second jaw 20.

The vise-like grip assembly 24 comprises a handle 52 having an inwardly facing longitudinal slot 54, being integral with and extending from the body 12. An adjustable abutment 56 is in the handle 52. A lever 58 is provided. A component 60 is for attaching in a pivotal manner a top end 62 of the lever 58 to a lower portion of the second jaw 20. A toggle link 64 is also provided.

A component 66 is for attaching in a pivotal manner a first end 68 of the toggle link 64 to the lever 58. A second end 70 of the toggle link 66 can extend through the longitudinal slot 54 in the handle 52, and make contact with the adjustable abutment 56 in the handle 52. When the person grasps the handle 52 and the lever 58 with one hand and squeezes, the lever 58 will move towards the handle 52 to cause the second jaw 20 to move towards the first jaw 14.

A coil spring 72 extends between the lower portion of the second jaw 20 and the handle 52, to normally urge the second jaw 20 away from the first jaw 14. The adjustable abutment 56 includes the handle 52 having a threaded end portion 74. An adjustment screw 76 is threaded into the threaded end portion 74 of the handle 52.

The first pivotal attaching component 60 is a pivot pin 78 extending through the top end 62 of the lever 58 and the lower portion of the second jaw 20. The second pivotal attaching component 66 is a pivot pin 80 extending through the lever 58 adjacent the first pivotal attaching component 60 and the first end 68 of the toggle link 64.

A release lever 82 is provided. An element 84 is for attaching in a pivotal manner the release lever 82 to the lever 58. The toggle link 64 has a stop portion 86 which makes contact with the release lever 82. When the release lever 82 is manually pivoted it will press against the stop portion 86 on the toggle link 64, to cause the second jaw 20 to move away from the first jaw 14. The pivotal attaching element 84 is a roll pin 88 extending through the lever 58 approximately midway thereof and the release lever 82.

OPERATION OF THE INVENTION

To use the chain pliers 10 the following steps should be taken:

1. Grasp the vise-like grip assembly 24 with one hand.
2. Engage the semi-circular groove 32 in the hook member 30 of the first jaw 14 with one pivot post 34 between the links 36 of the chain 26 at one end thereof.
3. Engage the semi-circular groove 46 in the hook member 44 of the second jaw 20 with one pivot post 34 between the links 36 of the chain 26 at an opposite end thereof.
4. Squeeze the lever 58 and the handle 52 so that the lever will move towards the handle 52, to cause the second jaw 20 to move towards the first jaw 14.
5. Adjust the adjustment screw 76 in the threaded end portion 74 of the handle 52, to keep the second jaw 20 in position towards the first jaw 14 and hold the chain 26 in its tightened condition.
6. Move the release lever 82 to cause the lever 58 to move away from the handle 52, to cause the second jaw 20 to move away from the first jaw 14, so that the chain 26 can be disengaged from the first jaw 14 and the second jaw 20.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A chain pliers comprising:

a) a body;

b) a first jaw having an L-shaped arm and a first hook member on an upper portion of said L-shaped arm, said hook member having a semi-circular groove and a notch facing inwardly therefrom, said groove capable of engaging with a pivot post between links of a chain;

c) means for attaching in a stationary manner said first jaw to a top end of said body comprising a rivet extending through the top end of said body and a lower portion of said first jaw, the lower and upper portions of said L-shaped arm of said first law being substantially at right angles to each other;

d) a second jaw including an L-shaped arm and a second hook member formed on an upper portion thereof, said second hook member having a semi-circular groove and a notch facing inwardly therefrom the latter said groove being capable of engaging another Divot post between links of said chain, the grooves in said arms facing each other;

e) means for attaching in a pivotal manner said second jaw to the top end of said body opposite from said first jaw comprising a pivot pin extending through the top end of said body and a lower portion of said second law, the lower and upper portions of said L-shaped arm of said second jaw being substantially at right angles to each other, the lower portions of said jaws being approximately in line with each other when the jaws are open;

f) a vise-like grip assembly between said body and said second jaw comprising a handle having an inwardly facing longitudinal slot integral with and extending from said body an adjustable abutment in said handle, a lever, means for attaching in a pivotal manner a top end of said lever to a lower portion of said second jaw, a toggle link, and means for attaching in a pivotal manner a first end of said toggle link to said lever, the second end of said toggle link extending through the longitudinal slot in said handle making contact with said adjustable abutment in said handle, so that a person can operate with one hand said grip assembly and move said second jaw towards said first jaw when squeezing said handle and said lever together, to engage with opposite ends of a chain to tighten said chain;

g) coil spring means extending between said second jaw and said handle to normally urge said second jaw away from said first jaw, h) said adjustable abutment including an adjustment screw threaded into a threaded end portion of said handle;

i) means for releasing said lever for permitting said second jaw to move away from said first jaw comprising a release lever, means for attaching in a pivotal manner one end of said release lever to a mid point of said lever, and said toggle link having a stop portion which makes contact with said release lever, so that when said release lever is manually pivoted it will press against said stop portion on said toggle link to cause said second jaw to move away from said first jaw.

* * * * *